US005970524A

United States Patent [19]

Becker et al.

[11] Patent Number: 5,970,524

[45] Date of Patent: Oct. 26, 1999

[54] PAIR OF SEPARABLY JOINED SOCKS OR STOCKINGS

[76] Inventors: Bernard Becker, Ludwig-Girtlerstrasse 11, D-51373 Leverkusen; Dennis De, Niehler Weg 62, D-50733 Köln, both of Germany

[21] Appl. No.: 09/173,352

[22] Filed: Oct. 15, 1998

Related U.S. Application Data

[63] Continuation of application No. PCT/EP97/01837, Apr. 12, 1997.

[30] Foreign Application Priority Data

Apr. 16, 1996 [DE] Germany ..... 196 14 937

[51] Int. Cl.[6] ..... A41B 1/00

[52] U.S. Cl. ..... 2/239; 2/409

[58] Field of Search ..... 2/239, 409, 919, 2/920, 912; 24/442, 440, 446, 450, 452

[56] References Cited

U.S. PATENT DOCUMENTS

| | | | |
|---|---|---|---|
| 2,663,877 | 12/1953 | Bohman | 2/239 X |
| 2,667,004 | 1/1954 | Sanson | 2/239 |
| 3,423,764 | 1/1969 | Cassling | 2/239 |
| 3,688,348 | 9/1972 | Klotz et al. | 24/16 |
| 4,058,853 | 11/1977 | Boxer et al. | 2/239 |
| 4,106,126 | 8/1978 | Traenkle | 2/239 X |
| 4,165,555 | 8/1979 | Boxer et al. | 2/239 X |
| 5,038,413 | 8/1991 | Ursino . | |
| 5,321,855 | 6/1994 | Ciuffo . | |
| 5,357,660 | 10/1994 | Smith | 2/239 X |
| 5,579,541 | 12/1996 | Christy et al. | 2/239 |
| 5,699,557 | 12/1997 | Johnson | 2/239 |
| 5,740,558 | 4/1998 | Messman | 2/239 |

FOREIGN PATENT DOCUMENTS

| | | |
|---|---|---|
| 2 722 062-A1 | 1/1996 | France . |
| 84 15 660 | 9/1984 | Germany . |
| 86 00 236 | 10/1986 | Germany . |
| 3803799 A1 | 8/1989 | Germany . |
| WO 96/10345 | 4/1996 | WIPO . |

*Primary Examiner*—Gloria Hale
*Attorney, Agent, or Firm*—Akin, Gump, Strauss, Hauer & Feld, L.L.P.

[57] ABSTRACT

A pair (1) of socks or stockings (2,3) may be joined together in a detachable fashion using a set heat-resistant, transparent fastening elements (4,5), in order to avoid sorting of the socks or stockings, e.g., after washing. Each of said fastening elements is firmly attached to a stocking or sock, preferably at its leg portion (6), in an area of the sock or stocking having a mesh density of at least 2000 MD, preferably at least 4000 MD.

19 Claims, 3 Drawing Sheets

PAIR OF SEPARABLY JOINED SOCKS OR STOCKINGS

CROSS REFERENCE TO RELATED APPLICATION

This application is a continuation of International Application PCT/EP97/01837, filed Apr. 12, 1997.

BACKGROUND OF THE INVENTION

The invention relates to a pair of socks or stockings which, when not worn, can be joined in a detachable fashion using preferably transparent, preferably heat-resistant fastening elements, in order to avoid sorting of matching socks.

After washing several pairs of socks, it is often difficult to assign matching socks to each other again, and in doing so, it is not uncommon that socks having a similar color in artificial light are assigned wrongly. Then, when looking at this pair of socks in natural light, it is noticed that the socks do not match, which often gives rise to embarrassment.

Therefore, quite a number of attempts have been made in the past to facilitate sorting of stockings or socks in pairs. Thus, for example, stockings or socks have been provided with an embroidered label.

Furthermore, a sock labelling device is known from U.S. Pat. No. 5,357,660, wherein identical labels are attached on both socks of each single pair, using an insertion joint. As a result of such identical labeling, the assignment of stockings or socks in pairs, e.g. following washing, is facilitated.

Also, attempts have been made to completely avoid sorting of stockings or socks in pairs by joining the stockings or socks together after taking them off, using a fastening means (see U.S. Pat. No. 5,038,413). This method is disadvantageous in that the fastening element, when located at the outward side of the leg portion of the stocking or sock, is clearly visible when wearing the stockings or socks. This effect is even enhanced as a result of cleaning of the socks or stockings, because the socks or stockings and the fastening means will undergo different discoloration after multiple washings. On the other hand, if the fastening element is attached at the inward side of the leg portion of the stocking or sock, or in an area of the stocking or sock which is covered by the shoe, the result for the wearer will normally be a disagreeable pinching or chafing, because the invention of U.S. Pat. No. 5,038,413 only provides permanent attachment of the fastening device. Another drawback of the fastening device illustrated in U.S. Pat. No. 5,038,413 is that the fastening elements normally require reinforcing elements located at the inward side of the sock, so that the fastening element would not be torn out of the sock.

If matching socks or stockings are simply joined with a clothes pin before washing, it often happens that this joint will come loose during washing, e.g., during spin-drying.

SUMMARY OF THE INVENTION

Therefore, the invention is based on the object of providing a combination in order to join together matching socks or stockings in a detachable and temporarily stable fashion, with none of the above-mentioned drawbacks occurring.

According to the invention, the object is accomplished in that a first, preferably heat-resistant, transparent fastening element is firmly attached to one stocking or one sock of a matching pair, to detachably receive a second, complementary, preferably heat-resistant, transparent fastening element which is firmly joined to the other sock or stocking.

According to another embodiment of the invention, said first and second, preferably heat-resistant, transparent fastening elements each represent complementary elements of a snap, a hook and loop, VELCRO® fastener, an insertion fastener, a swivel fastener, or hook and eyelet. The fastening elements are preferably made of transparent plastic, which preferably is resistant to boiling and/or heat.

In another preferred embodiment of the invention, said first and second fastening elements are either sewed on or woven into both socks or both stockings, or pasted on the socks or stockings, using a suitable adhesive which is resistant to boiling and/or heat.

In another, likewise preferred embodiment of the invention, each of said first and second fastening elements is inserted in a preferably heat-resistant, preferably transparent counterpart which is located at the respective opposite side of the fabric of the sock or stocking and may optionally extend through the sock or stocking. This insertion joint may preferably be released before wearing the socks or stockings, so that the fastening elements are joined firmly, but preferably not permanently, to the socks or stockings. In this way, disagreeable pinching and chafing is avoided for the wearer. Subsequent to wearing the socks or stockings, the first and second fastening elements are preferably reattached.

It is particularly preferred that the first and second fastening elements be attached to the leg portion, and even more preferably at the outward side of the leg, on the inside or outside of the sock or stocking.

According to the invention, the object may also be accomplished by attaching a first fastening element to one sock or stocking of a pair of socks or stockings, to detachably receive a second, complementary fastening element, said first and second fastening elements being joined to the respective stocking or sock by means of a joining strap. Preferably, the joining strap itself is attached to the sock or stocking using a demountable and remountable insertion joint.

According to another embodiment of the invention, said first and second fastening elements each represent complementary elements of a snap, a VELCRO® fastener, a swivel fastener, or a hook and eyelet made of a rustproof material, preferably transparent plastic which is preferably is resistant to boiling and/or heat.

In another preferred embodiment of the invention, each of said first and second fastening elements either is sewed on the joining strap or woven into the joining strap, or pasted on, as mentioned above.

In another, likewise preferred embodiment of the invention, each of said first and second fastening elements is inserted in a counterpart which is located at the respective opposite side of the joining strap and may extend through the joining strap.

It is particularly preferred that the joining strap be attached to the leg portion of the sock or stocking and/or be made of the same material as the socks or stockings.

It is even more preferred that the joining strap be attached at the leg inward side of the sock or stocking and covered by same during wearing the socks or stockings.

In order to avoid tearing out the fastening elements or the demountable insertion device, it was found that a stocking or sock must have a mesh density (MD), determined according to DIN 53883, of at least 2000 MD to prevent the fastening element or the demountable insertion device from being torn out of the sock or stocking, even upon a repeated strain of more than 100 washings. If a snap, insertion fastener or hook and eyelet is used as the fastening element, the stocking or sock should have a mesh density of preferably at least 4000 MD. In those cases where a sock or stocking does not have the required mesh density, the knitted fabric should be reinforced according to the above statements within a radius of up to at least 1–2 cm around the fastening element and in the area of the fastening element.

Therefore, the invention is also directed to a method of attaching a combination of joinable and detachable fastening elements to a pair of socks or stockings using the measures indicated above, characterized in that the knitted fabric of the sock or stocking, at least in that area where the fastening element is attached and preferably within a radius of at least 1–2 cm, has a mesh density of at least 2000 MD, preferably 4000–5000 MD.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiment(s) which are presently preferred. It should be understood, however, that the invention is not limited to the precise arrangements and instrumentalities shown. In the drawings.

DETAILED DESCRIPTION OF THE INVENTION

Figure 1:
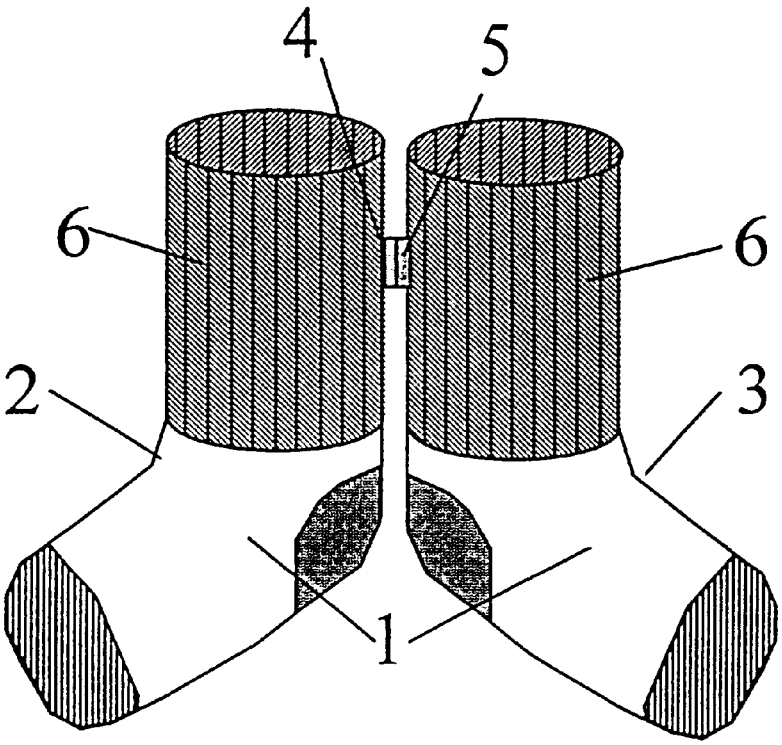
FIG. 1 shows a pair of socks which, according to the invention, are joined by a transparent snap in a detachable fashion.

FIG. 1 illustrates one embodiment of the invention wherein a pair of socks 1 comprising the socks 2 and 3 is joined together in a detachable fashion by means of a transparent snap comprising the fastening elements 4 and 5, which are woven or sewed into or pasted onto the leg portions 6 of the respective socks 2 and 3. When wearing the socks, both parts of the snap are detached from each other. Subsequent to wearing, e.g., for washing or keeping in the wardrobe, the matching pair of socks is rejoined by means of the transparent snap to ensure that the pair of socks will remain together.

Figure 2:
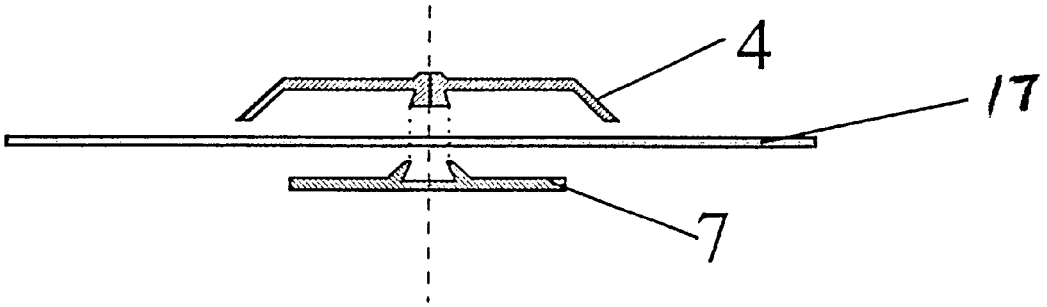
FIG. 2 is a cross-sectional view of a fastening element and its separated counterpart positional adjacent to a sock.

FIG. 2 illustrates the manner in which the fastening element 4 of the transparent snap is inserted in its transparent counterpart 7. The counterpart 7 is positioned to extend through a fabric section 17 of sock 2. The fabric will thus be clamped between the one fastening element 4 of the snap and its counterpart 7.

Figure 3:
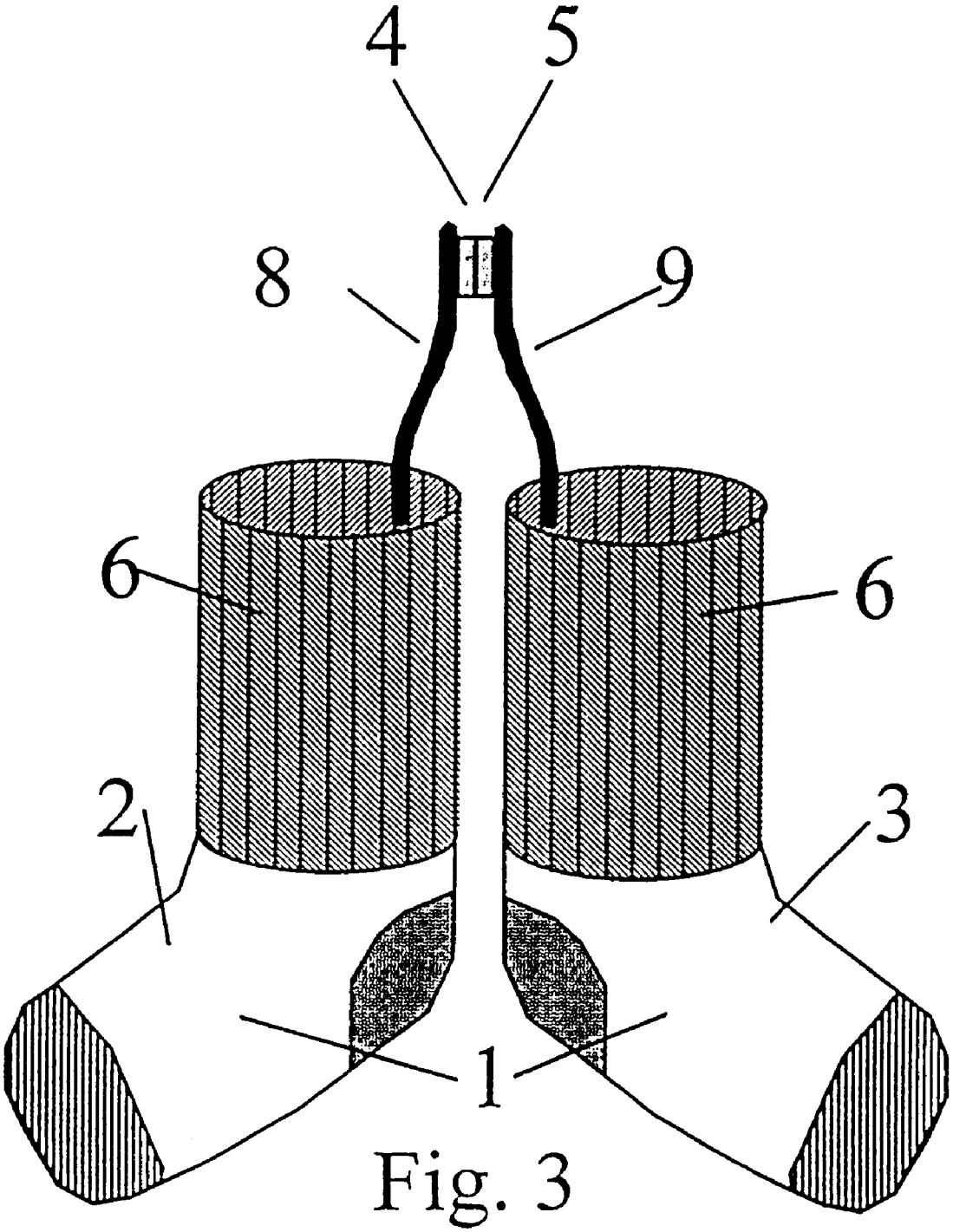
FIG. 3 shows a pair of socks which, according to the invention, are joined together by fastening elements situated on joining straps.

FIG. 3 illustrates the manner in which a pair 1 of socks 2, 3 is joined together when both parts of a snap are joined to the sock via respective straps 8 and 9. The snap parts 4 and 5 are sewed on the respective straps. Each strap is knitted into a respective sock in its leg portion 6. In the non-joined condition, e.g, when wearing the socks, the straps may be inserted between the leg and its sock.

Figure 4:
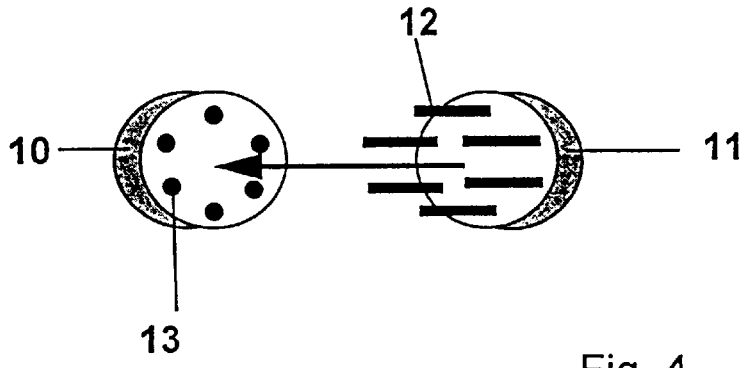
FIG. 4 shows the two separated parts of a detachable insertion joint used to mount the fastening element on a sock.

FIG. 4 shows an insertion joint for detachable fastening of the first and second fastening elements to a sock. The pins 12 on one part 11 of the insertion joint are passed through the sock 2, 3 and thereafter detachably secured in the holes 13 of the other part 10 of the insertion joint.

Figure 5:
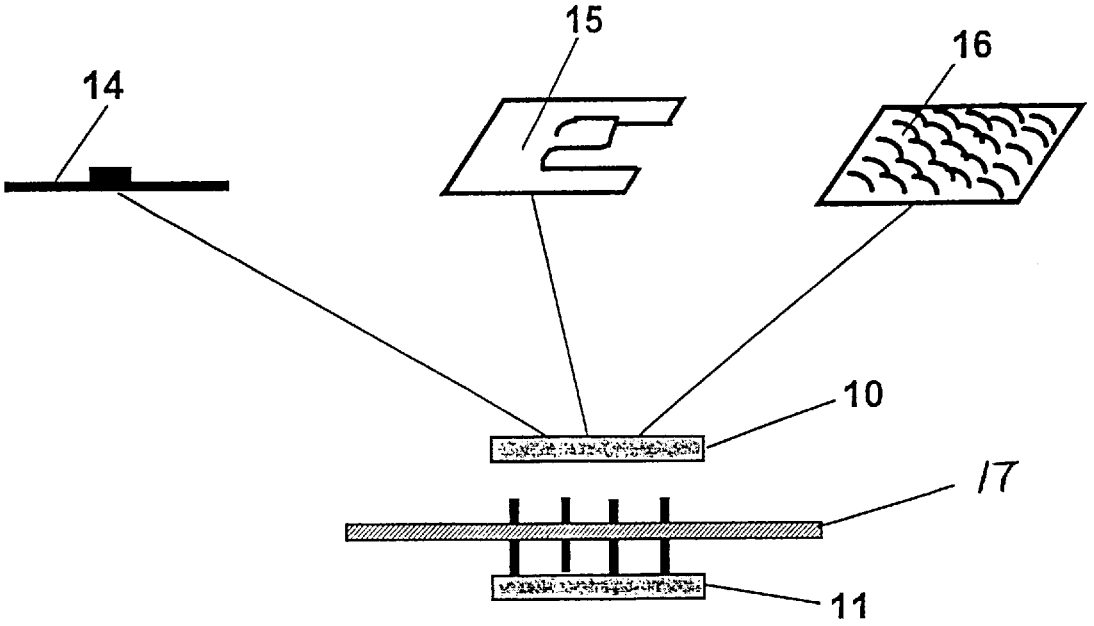
FIG. 5 is a cross-sectional view of a sock with the insertion joint from FIG. 4, separated but positioned with a first part through the sock and alternative sock fastening elements mountable on the other part of the insertion joint.

FIG. 5 shows the manner in which the pins 12 have been passed through fabric 6 of the sock and may now be detachably secured in the holes of the other part 10 of the insertion joint. Various fastening elements may be attached at the side opposite holes 13 of the other part 10 of the insertion joint, such as a snap 14, a hook 15, or a hook and loop, VELCRO® fastener 16.

It will be appreciated by those skilled in the art that changes could be made to the embodiment(s) described above without departing from the broad inventive concept thereof. It is understood, therefore, that this invention is not limited to the particular embodiment(s) disclosed, but it is intended to cover modifications within the spirit and scope of the present invention as defined by the appended claims.

We claim:

1. A pair (1) of socks or stockings (2,3) which may be joined in a detachable fashion, comprising a first sock or stocking (2) having firmly attached thereto a first fastening element (4) adapted to detachably receive a second, complementary fastening element (5) which is firmly attached to a second sock or stocking (3), wherein the socks or stockings (2, 3), at least in areas where the fastening elements (4,5) are attached, have a mesh density of at least 2000 MD.

2. The pair of socks or stockings according to claim 1, wherein a mesh density of at least 2000 MD is present within a radius of up to 2 cm from the areas where the fastening elements (4,5) are attached.

3. The pair of socks or stockings according to claim 1, wherein the entire socks or stockings (2,3) have a mesh density of at least 2000 MD.

4. The pair of socks or stockings according to claim 1, wherein the mesh density is at least 4000 MD.

5. The pair of socks or stockings according to of claim 1, wherein the fastening elements (4,5) are transparent.

6. The pair of socks or stockings according to claim 1, wherein the first and second fastening elements (4,5) are heat-resistant, and each fastening element (4,5) represents a complementary part of a fastener selected from the group consisting of a snap, a hook and loop fastener, an insertion fastener, and a hook and eyelet.

7. The pair of socks or stockings according to claim 1, wherein the first and second fastening elements (4,5) are woven into the socks or stockings (2,3).

8. The pair of socks or stockings according to claim 1, wherein the first and second fastening elements (4,5) are sewed onto the socks or stockings (2,3).

9. The pair of socks or stockings according to claim 1, wherein the first and second fastening elements (4,5) are pasted onto the socks or stockings (2,3).

10. The pair of socks or stockings according to claim 1, wherein each of the first and the second fastening elements (4,5) is inserted in a respective counterpart (7) which is located at a respectively opposite side of a fabric section (17) of a sock or stocking (2,3) from a side wherein the fastening element (4,5) contacts the fabric, and one of the fastening element (4,5) and its respective counterpart (7) extends through the fabric section (17) of sock or stocking (2,3).

11. The pair of socks or stockings according to claim 1, wherein each of the first and second fastening elements (4,5)

is attached to a respective leg portion (6) of the socks or stockings (2,3).

12. The pair of socks or stockings according to claim 11, wherein each of the first and second fastening elements (4,5) is attached inside of the sock or stocking (2,3).

13. The pair of socks or stockings according to claim 11, wherein each of the first and second fastening elements (4,5) is attached outside of the sock or stocking (2,3).

14. The pair of socks or stockings according to claim 1, wherein the fastening elements (4,5) are connected to the socks or stockings (2,3) by respective straps (8,9).

15. A method of attaching an arrangement of fastening elements to a pair of socks or stockings, comprising providing a pair of fastening elements (4,5) which are adapted to be joined together in a detachable fashion, providing a pair of socks or stockings (2,3) which have a mesh density of at least 2000 MD at least in respective areas where the fastening element (4,5) are to be attached, and attaching the respective fastening elements (4,5) to the socks or stockings (2,3) in said areas.

16. The method according to claim 15, wherein the fastening elements (4,5) are attached to the socks or stockings (2,3) by weaving into said areas.

17. The method according to claim 15, wherein the fastening elements (4,5) are attached to the socks or stockings (2,3) by pasting onto said areas.

18. The method according to claim 15, wherein the fastening elements (4,5) are attached to the socks or stockings (2,3) by sewing onto said areas.

19. The method according to claim 15, wherein the fastening elements (4,5) are attached to the socks or stockings (2,3) by inserting in a respective counterpart (7) which is located at a respective opposite side of a fabric section (17) of the sock or stocking (2,3) from a side where the fastening element (4,5) contacts the fabric section (17) and one of the fastening element (4,5) and its respective counterpart (7) extends through the sock or stocking.

* * * * *